US009338534B2

(12) United States Patent
Zhang

(10) Patent No.: US 9,338,534 B2
(45) Date of Patent: May 10, 2016

(54) MINIATURE SPEAKER

(71) Applicant: Zuncheng Zhang, Shenzhen (CN)

(72) Inventor: Zuncheng Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/524,087

(22) Filed: Oct. 27, 2014

(65) Prior Publication Data

US 2016/0021440 A1 Jan. 21, 2016

(30) Foreign Application Priority Data

Jul. 18, 2014 (CN) ..... 2014 2 0401961 U

(51) Int. Cl.

| | |
|---|---|
| ***H04R 9/06*** | (2006.01) |
| ***H04R 1/00*** | (2006.01) |
| ***H04R 7/00*** | (2006.01) |
| ***H04R 1/06*** | (2006.01) |
| ***H04R 9/02*** | (2006.01) |

(52) U.S. Cl.

CPC .. *H04R 1/00* (2013.01); *H04R 1/06* (2013.01); *H04R 7/00* (2013.01); *H04R 9/025* (2013.01); *H04R 9/06* (2013.01); *H04R 2400/11* (2013.01); *H04R 2499/11* (2013.01)

(58) Field of Classification Search

CPC ..... H04R 1/02; H04R 1/06; H04R 7/04; H04R 7/127; H04R 7/18; H04R 9/025; H04R 9/04; H04R 9/045; H04R 9/06; H04R 2209/041; H04R 2400/07; H04R 2400/11

USPC ..... 381/332, 334, 396, 398, 400, 401, 403, 381/407, 409, 410, 412, 420, 430, 431, 433

See application file for complete search history.

(56) References Cited

U.S. PATENT DOCUMENTS

| | | | | |
|---|---|---|---|---|
| 6,404,896 | B1 * | 6/2002 | Yoo | H04R 9/045 381/401 |
| 6,594,372 | B2 * | 7/2003 | Nakaso | H04R 7/127 381/396 |
| 2012/0008810 | A1 * | 1/2012 | Lu | H04R 1/021 381/332 |
| 2012/0213398 | A1 * | 8/2012 | Itoh | H04R 9/025 381/334 |

* cited by examiner

*Primary Examiner* — Huyen D Le
(74) *Attorney, Agent, or Firm* — IPro, PLLC; Na Xu

(57) ABSTRACT

A miniature speaker includes a frame having a sidewall including a first upper thinner portion and a first lower thicker portion, a magnetic circuit unit, a voice coil having a lead wire, and a diaphragm driven by the voice coil. The magnetic circuit unit has a yoke, a magnet mounted on the yoke, a pole plate attached to the magnet, and a magnetic gap. The yoke further includes a lower plate and a side extending from the lower plate, the side including a second thinner portion and a second lower thicker portion. A recess is accordingly formed by the thinner portions and the thicker portions for accommodating the lead wire of the voice coil. The recess defines a bottom formed by the thicker portions and an opening formed by the thinner portions thereby providing an enlarged space to the lead wire.

14 Claims, 5 Drawing Sheets

MINIATURE SPEAKER

FIELD OF THE INVENTION

The present invention relates to electro-acoustic transducers, more particularly to a miniature speaker used in an electronic device.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

Generally, a miniature speaker related to the present disclosure electrically connects to external circuits via elastic contacts. Such a miniature speaker includes a frame, a sound generator accommodated in the frame, and contacts positioned by the frame. The sound generator includes a magnetic circuit unit, a diaphragm, and a voice coil driving the diaphragm to vibrate. The voice coil is configured to receive corresponding electrical signals from the external circuit via the elastic contacts by electrically connecting leads wires thereof to the contacts. Generally, the leads wires extend in a space formed between the magnetic circuit unit and the frame. Due to the small size of the miniature speaker, the space where the lead wires extend is so limited that the lead wires are easy to be broken during assembly or vibration of the voice coil, which leads the miniature speaker to failure, or causes noises.

Accordingly, an improved miniature speaker which can overcome the disadvantages described above is desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
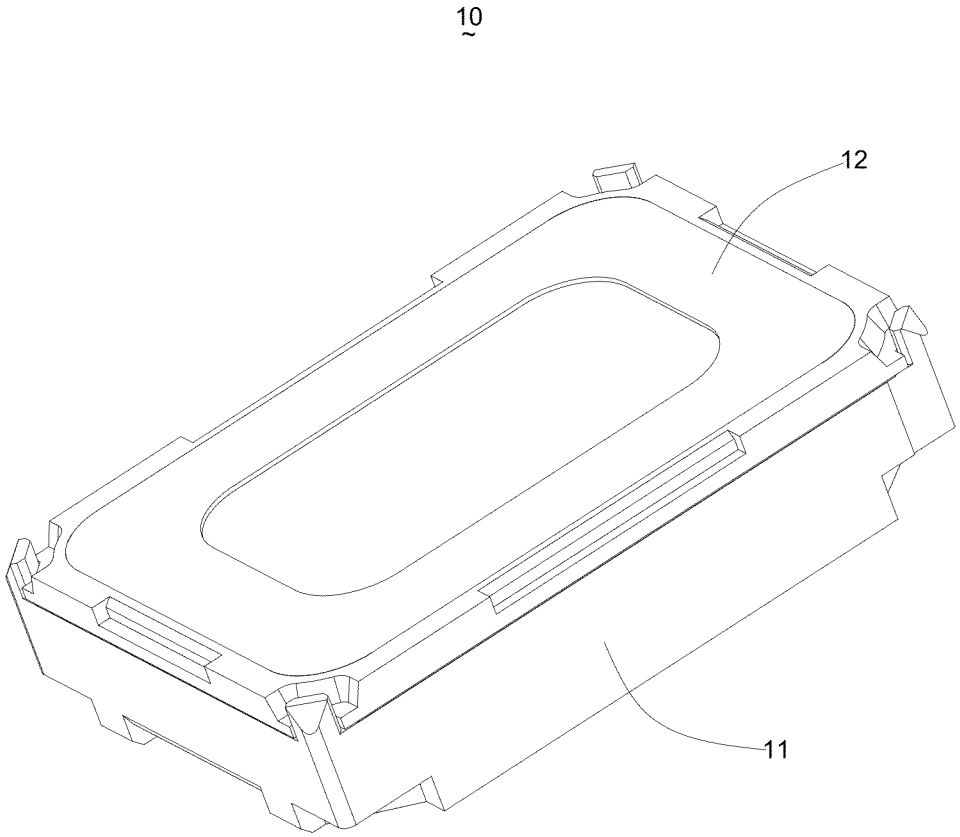
FIG. 1 is an isometric view of a miniature speaker in accordance with a first exemplary embodiment of the present disclosure.

Referring to FIG. 1, a miniature speaker 10 in accordance with a first exemplary embodiment of the present disclosure is used in an electronic device, such as a mobile phone. The miniature speaker 10 includes a frame 11 and a cover 12 cooperatively forming an accommodating room. Generally, the frame 11 is made from plastic, ceramic, or plastic with metal embedded in the plastic. The cover 12 is generally made of metal, plastic, ceramic, or plastic with metal embedded in the plastic. The cover 12 is an optional component for forming the miniature speaker, and without the cover 12, the miniature speaker 10 is also workable.

Figure 2:
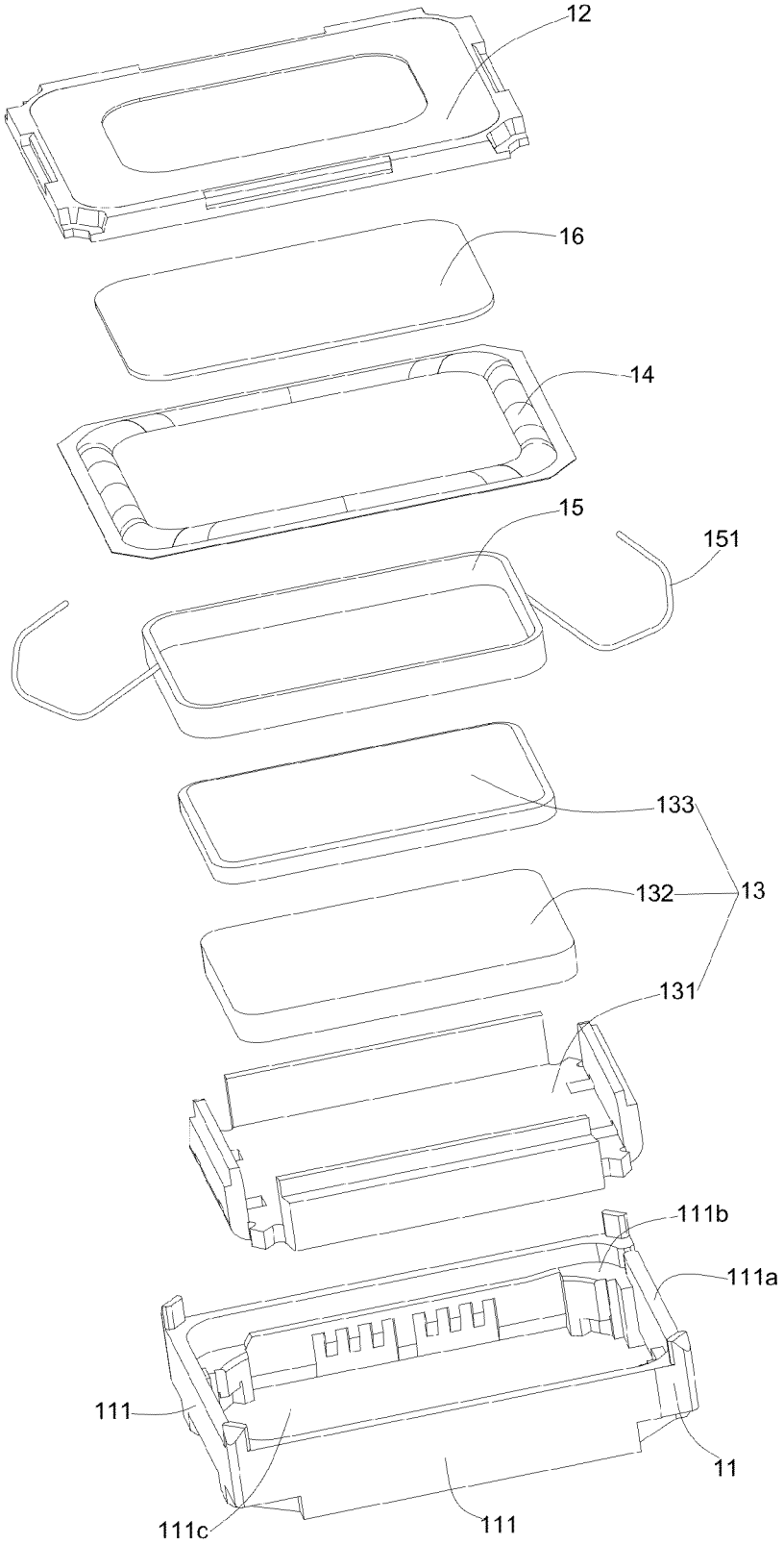
FIG. 2 is an isometric and exploded view of the miniature speaker in FIG. 1.

FIG. 2 is an exploded view for illustrating the detailed structure of the miniature speaker. The miniature speaker 10 further includes a magnetic circuit unit 13 positioned by the frame 11, a diaphragm 14 supported by the frame 11 and arranged above the magnetic circuit unit 13, a voice coil 15 connecting to the diaphragm 14 for driving the diaphragm 14, and a dome 16 positioned on the diaphragm 14. The voice coil 15 further includes a pair of lead wires 151. The frame 11 comprises a plurality of sidewalls 111 forming a cavity 111*c* for accommodating the magnetic circuit unit 13. The sidewall 111 defines a top surface 111*a* for supporting the diaphragm 14 and the cover 12. In this embodiment, each of the sidewalls 111 includes a first step 111*b* lower than the top surface 111*a* of the sidewall 111. For forming the first step 111*b*, the sidewall 111 includes an upper thinner portion and a lower thicker portion. Alternatively, the first step 111*b* may be configured on selected sidewall 111 according to the actual position of the lea wires 151 of the voice coil 15. The magnetic circuit unit 13 includes a yoke 131 made of magnetic conduct material, a magnet 132 positioned on the yoke 131, and a pole plate 133 attached to the magnet 132.

Figure 3:
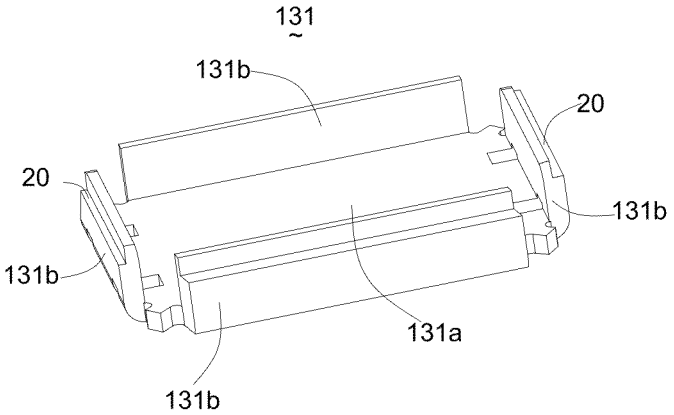
FIG. 3 is an isometric view of a yoke of a magnetic circuit unit used in the miniature speaker in FIG. 1.

Referring to FIGS. 2-3, the yoke 131 includes a lower plate 131*a* for supporting the magnet 132 thereon, and a plurality of sides 131*b* extending vertically from edges of the lower plate 131*a* and having upper surfaces 21. Corresponding to the first steps 111*b* of the frame 11, the sides 131*b* of the yoke 131 further include a plurality of second steps 20 lower than the upper surfaces 21. Similar to the first steps 111*b*, the second steps 20 may also be configured on selected sides 131*b* according to the actual positions of the lead wires 151 of the voice coil 15. For forming the second step 20, the side 131*b* includes an upper thinner portion and a lower thicker portion. The word "upper" means a position that is closer to the diaphragm, and the word "lower" means a position that is farther from the diaphragm.

Figure 4:
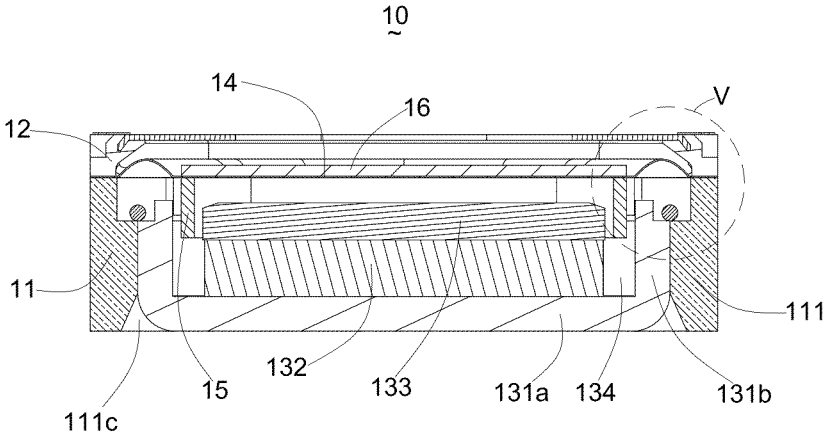
FIG. 4 is a cross-sectional view of the miniature speaker in FIG. 1.

Referring to FIG. 4, together with FIG. 3, when the miniature speaker 10 is assembled, the magnetic circuit unit is accommodated in the cavity 111*c* with the sides 131*b* of the yoke 131 abutting against the sidewalls 111 of the frame 11. The magnet 132 sits on the lower plate 131*a* of the yoke 131, and the pole plate 133 covers the magnet 132. The side 131*b*, the magnet 132, and the pole plate 133 cooperatively form a magnetic gap 134. The voice coil 15 is connected with the diaphragm 14 and is partially received in the magnetic gap 134. The dome 16 attaches to the diaphragm 14 for balancing the vibration of the diaphragm, or for enhancing the vibration of diaphragm. In this embodiment, the dome 16 attaches to a top surface of the diaphragm, and alternatively, the dome may also attach to a bottom surface of the diaphragm. The cover 12 mounts on the sidewall 111 and above the diaphragm for protecting the diaphragm 14.

Figure 5:
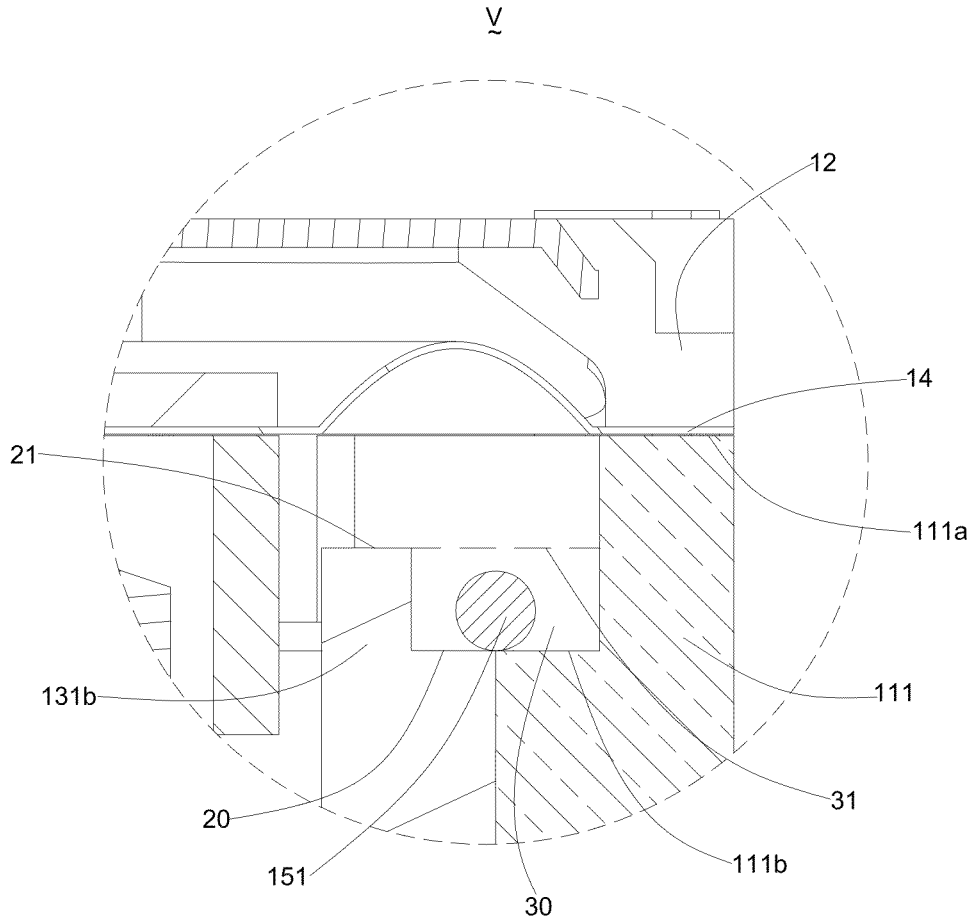
FIG. 5 is an enlarged view of Circled Part V in FIG. 4.

Referring to FIG. 5, it is obviously shown that the diaphragm 14 is sandwiched between the cover 12 and the top surface 111*a* of the sidewall 111. The side 131*b* of the yoke abuts against the sidewall 111 of the frame. The first step 111*b* is coplanar with the second step 20 thus forming a recess 30.

The recess 30 has a bottom cooperatively formed by the first and second steps 111*b*, 20. The recess 30 defines an opening 31 that is illustrated in dashed line in FIG. 5. An inner diameter of the opening 31 is determined by a distance from the upper surface 21 to the sidewall 111 above the first step 111*b*. The inner diameter of the recess 30 is substantially equal to a width of the bottom. The lead wires 151 are arranged in the recess 30. The recess 30 is formed by a part of the yoke and a part of the frame, which provides a sufficient space for the lead wires. By virtue of this recess, it is easy to arrange the lead wires, and it prevents the lead wires from being broken during vibration of the diaphragm.

Figure 6:
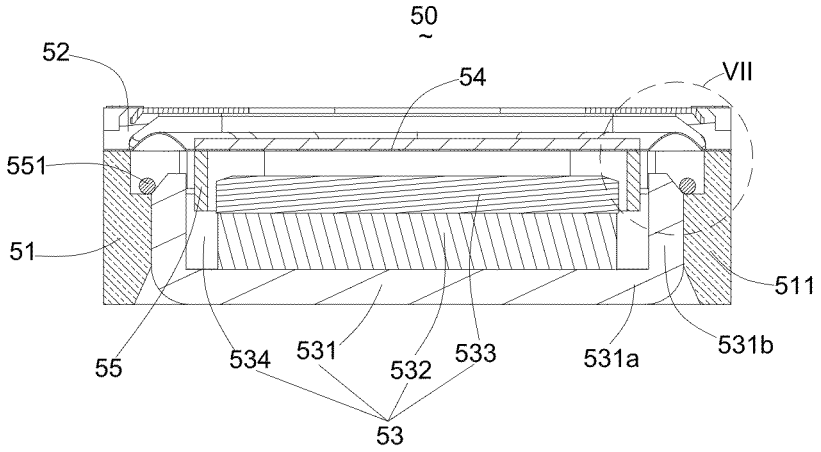
FIG. 6 is a cross-sectional view of a miniature speaker in accordance with a second exemplary embodiment of the present disclosure.

Referring to FIG. 6, a miniature speaker 50 in accordance with a second exemplary embodiment of the present disclosure includes a frame 51, a cover 52 cooperatively forming a receiving space, a magnetic circuit unit 53 accommodated in the receiving space, a diaphragm 54 supported by the frame 51, and voice coil 55 driving the diaphragm 54 to vibrate for generating audible sounds. The frame 51 includes a sidewall 511 for supporting the magnetic circuit unit 53. The magnetic circuit unit 53 comprises a yoke 531 having a lower plate 531*a* and a side 531*b* extending from the lower plate 531*a*, a magnet 532 positioned on the lower plate 531*a* of the yoke 531, a pole plate 533 attached to the magnet 532, and a magnetic gap 534 for partially receiving the voice coil 55. When assembled, the side 531*b* of the yoke 53 abuts against the sidewall 511 of the frame 51, thus the magnetic circuit unit 53 is supported by the frame 51.

Figure 7:
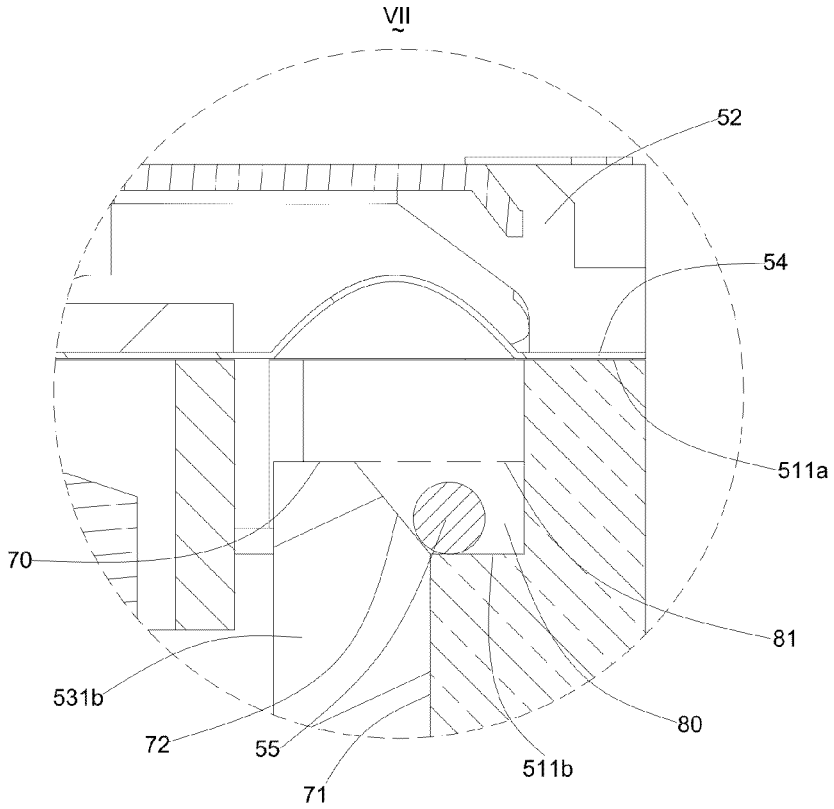
FIG. 7 is an enlarged view of Circled Part VII in FIG. 6.

Referring also to FIG. 7, the sidewall 511 of the frame 51 includes a top surface 511*a* for supporting an edge of the diaphragm 54, and the cover 52 engages with the top surface 511*a* for sandwiching the edge of the diaphragm therebetween. The sidewall 511 of the frame 51 further includes a step 511 lower than the top surface 511*a*. The side 531*b* further includes a upper surface 70 higher than the step 511*b* of the sidewall 511 of the frame 51, an outer wall 71 abutting against the sidewall 511 of the frame 51, and a bevel 72 extending from the upper surface 70 to the outer wall 71. When assembled, the bevel 72 starts from the upper surface 70, and ends at the step 511*b*. The bevel 72, the step 511*b* and the sidewall 511*b* cooperatively form a recess 80. The lead wire is accordingly arranged in the recess 80. The step 511*b* serve as a bottom of the recess 80, and the recess 80 defines an opening 81 that is illustrated in dashed line. An inner diameter of the opening 81 is determined by distance from the upper surface 70 to the sidewall 511. The inner diameter 81 is greater than the width of the step 511*b*. By virtue of the bevel 71, the recess 80 is enlarged and a sufficient space is provided to the lead wire.

Figure 8:
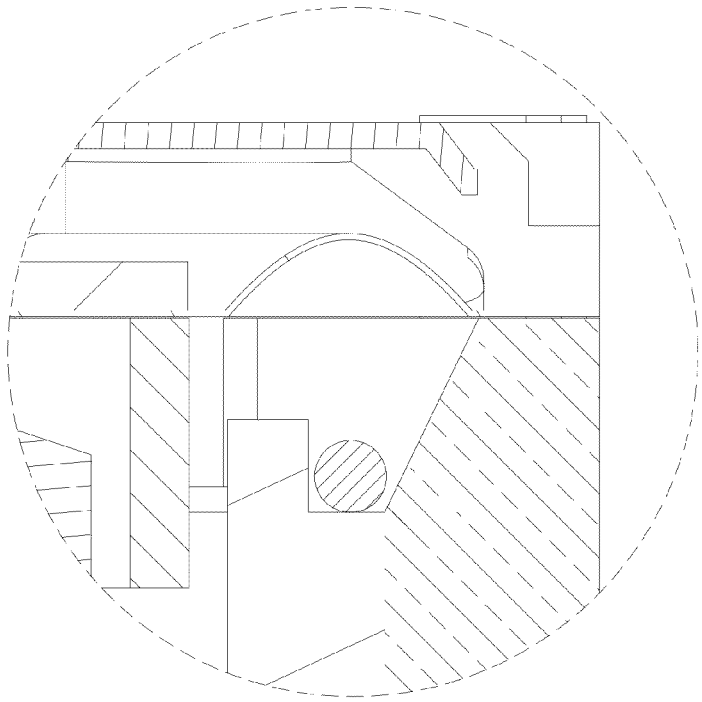
FIG. 8 is an illustration of a miniature speaker in accordance with a third embodiment of the present disclosure.

Referring back to the first embodiment, each of the side of the yoke and the sidewall of the frame provides a step serving as the bottom of the recess. Accordingly, the opening of the recess has an inner diameter greater than a width of each of the steps, by which the recess is enlarged. Regarding the second embodiment, the sidewall of the frame provides a step serving as the bottom of the recess, and the side of the yoke provides a bevel having a start point, i.e. the upper surface, far away from the sidewall of the frame and an end closer to the sidewall of the frame, by which the recess is enlarged. Obviously, it is understood that it is also possible that the sidewall of the frame provides a bevel, and the side of the yoke provides a step, as shown in FIG. 8. When the sidewall of the frame provides a step, the sidewall is divided into an upper thinner portion and a lower thicker portion. When the side of the yoke provides a step, the side is divided into an upper thinner portion and a lower thicker portion. When the sidewall of the frame provides a bevel, the sidewall is in fact divided into an upper thinner portion and a lower thicker portion. Similarly, when the side of the yoke provides a bevel, the side is also divided into an upper thinner portion and a lower thicker portion. The thicker portions define the bottom of the recess, and the thinner portions define the opening of the recess. For providing the lead wire with an enlarged and sufficient space, the opening has an inner diameter greater than a width of the bottom.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame including a sidewall, the sidewall including a top surface and a first step lower than the top surface;

a magnetic circuit unit supported by the sidewall of the frame, the magnetic circuit unit including a yoke having a lower plate and a side extending from the lower plate, a magnet positioned on the lower plate, and a pole plate attached to the magnet; the side including an upper surface and a second step lower than the upper surface and coplanar with the first step;

a diaphragm arranged above the magnetic circuit unit;

a recess formed by the first step, the second step, a portion of the side above the second step, and a portion of the sidewall above the first step, the first and second steps forming a bottom of the recess, and the portions above the first and second steps forming an opening of the recess, the opening having an inner diameter greater than a width of each of the first and second steps;

a voice coil having a lead wire for driving the diaphragm, the lead wire at least partially accommodated in the recess.

2. The miniature speaker as claimed in claim 1 further comprising a cover engaging with the frame for sandwiching an edge of the diaphragm therebetween.

3. The miniature speaker as claimed in claim 1 further comprising a dome attaching to the diaphragm.

4. A miniature speaker, comprising:

a frame including a sidewall, the sidewall including a top surface;

a magnetic circuit unit supported by the sidewall of the frame, the magnetic circuit unit including a yoke having a lower plate and a side extending from the lower plate, a magnet positioned on the lower plate, and a pole plate attached to the magnet; the side including an upper surface;

a diaphragm supported by the frame;

a voice coil driving the diaphragm and having a lead wire;

one of the sidewall and the side including a step, and the other of the sidewall and the side including a bevel extending to the step;

a recess formed by the step and the bevel for accommodating the lead wire of the voice coil, the recess defining an opening; wherein the step serves as a bottom of the recess, and the opening has an inner diameter greater than a width of the bottom.

5. The miniature speaker as claimed in claim 4, wherein the step is formed on the sidewall of the frame and is lower than the top surface of the sidewall, and the bevel is formed on the side extending from the upper surface to the step.

6. The miniature speaker as claimed in claim 4, wherein the step is formed on the side of the yoke and is lower than the upper surface of the side, and the bevel is formed on the sidewall extending from the top surface to the step.

7. The miniature speaker as claimed in claim 5, wherein the inner diameter of the opening is determined by a distance from the upper surface of the side of the yoke to the sidewall of the frame.

8. The miniature speaker as claimed in claim 6, wherein the inner diameter of the opening is determined by a distance from the top surface of the sidewall of the frame to the side of the yoke.

9. A miniature speaker, comprising:

a frame having a sidewall including a first upper thinner portion and a first lower thicker portion;

a magnetic circuit unit having a yoke, a magnet mounted on the yoke, a pole plate attached to the magnet, and a magnetic gap; the yoke including a lower plate and a side extending from the lower plate, the side including a second thinner portion and a second lower thicker portion;

a voice coil partially received in the magnetic gap, and having a lead wire;

a diaphragm driven by the voice coil;

a recess formed by the thinner portions and the thicker portions, and defining a bottom formed by the thicker portions and an opening formed by the thinner portions.

10. The miniature speaker as claimed in claim 9, wherein the sidewall includes a first step for diving the sidewall into the first upper thinner portion and the first lower thicker portion.

11. The miniature speaker as claimed in claim 10, wherein the side of the yoke includes a second step for dividing the side into the second upper thinner portion and the second lower thicker portion.

12. The miniature speaker as claimed in claim 11, wherein the first step is coplanar with the second step.

13. The miniature speaker as claimed in claim 9, wherein the sidewall includes a step for dividing the sidewall into the first upper thinner portion and the first lower thicker portion, and the side of the yoke includes a bevel extending to the step for dividing the side into the second upper thinner portion and the second lower thicker portion.

14. The miniature speaker as claimed in claim 9, wherein the sidewall includes a bevel for dividing the sidewall into the first upper thinner portion and the first lower thicker portion, and the side of the yoke includes a step for dividing the side into the second upper thinner portion and the second lower thicker portion.

* * * * *